United States Patent [19]

Guzowski et al.

[11] Patent Number: 4,612,073

[45] Date of Patent: Sep. 16, 1986

[54] ALUMINUM GRAIN REFINER CONTAINING DUPLEX CRYSTALS

[75] Inventors: Matthew M. Guzowski, Wernersville; David A. Sentner, Pottstown; Geoffrey K. Sigworth, Reading, all of Pa.

[73] Assignee: Cabot Corporation, Boston, Mass.

[21] Appl. No.: 637,174

[22] Filed: Aug. 2, 1984

[51] Int. Cl.[4] ..... C22C 21/00

[52] U.S. Cl. ..... 148/415; 148/159

[58] Field of Search ..... 420/552; 148/415, 437, 148/159

[56] References Cited

U.S. PATENT DOCUMENTS 3,785,807 1/1974 Backerud ..... 420/552

*Primary Examiner*—R. Dean

*Attorney, Agent, or Firm*—Joseph J. Phillips; Jack Schuman

[57] ABSTRACT

Disclosed is a new aluminum grain refiner alloy with a controlled, effective content of "duplex" crystals. The duplex crystals are made by (1) producing aluminides that contain boron in solution, and by (2) aging said aluminide in a manner to precipitate at least part of the boron to form the duplex crystals. The duplex crystals have been discovered to be extremely potent grain refining agents.

2 Claims, 12 Drawing Figures

2000X

2000X

4000X

1500X

2000X

3000X

THIS INVENTION

5000X

5000X

| | OPERATION | IMPORTANT OPERATING PARAMETERS |
|---|---|---|
| 1) | MELT ALUMINUM AND TURN ON STIRRER | METAL TEMPERATURE<br>STIRRING SPEED |
| 2) | ADD "EXCESS" TITANIUM | METAL (REACTION) TEMPERATURE<br>STIRRING SPEED<br>AMOUNT OF TITANIUM |
| 3) | ADD FLUX | METAL (REACTION) TEMPERATURE<br>STIRRING SPEED<br>FLUX RATIO |
| 4) | DECANT SALT | TIME ALLOWED FOR MOLTEN SALT TO REACT (BECOME SPENT) |
| 5) | POUR REFINER INTO HOLDING FURNACE | HOLDING TIME<br>HOLDING TEMPERATURE<br>STIRRER SPEED |
| 6) | CAST THE GRAIN REFINER | CASTING ENDS THE PROCESSING |

FIG. 7

ALUMINUM GRAIN REFINER CONTAINING DUPLEX CRYSTALS

This invention relates to a novel aluminum grain refiner; and, more specifically, to an Al-Ti-B grain refiner containing an improved structure. A method to produce the refiner is also disclosed. Typically, aluminum refiner alloys of this invention consist essentially of, in weight percent, 0.05 to 5 boron, 2 to 12 titanium and the balance aluminum plus normal impurities.

BACKGROUND

It is possible to classify the prior art of commercial grain refiners in two main catagories based on chemical composition, and these two catagories can be broken down further into two subcategories based on structure. This classification is depicted below:

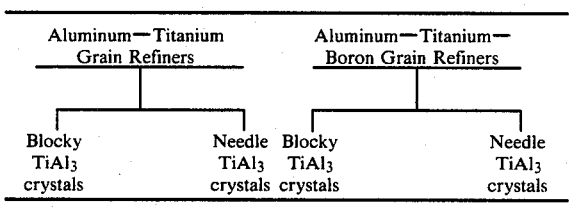

This classification runs counter to that usually found in the prior art. In the past, the primary means used to describe a grain refiner was the bulk chemistry of the alloy. Even the use of the word "alloy" is somewhat questionable. Since the solubilities of titanium and boron in liquid aluminum metal are small, nearly all titanium and boron are present as $TiAl_3$ and boride crystals. Therefore, changing the bulk composition of the alloy only changes the relative proportion of these three phases: aluminum metal, aluminides, and borides.

The morphology of the aluminide crystals in aluminum-titanium alloys is determined by the process used to produce this material. For a needle-like structure, the titanium mus first be put into liquid solution at high temperature. Then $TiAl_3$ will precipitate in needle form upon cooling. The size of needles is dependent on the cooling rate. The blocky structure results from a growth of $TiAl_3$ directly from the source of titanium in the presence of a liquid solution saturated in titanium. This occurs at temperatures where the solubility of titanium in the liquid is fairly small; i.e., less than about 900° C. The blocky crystals can be very small initially and grow through a process of agglomeration and recrystallization.

The structure of $TiAl_3$ present is dependent solely on the process used. It does not depend on composition. It is possible to get 100% blocky or 100% needle structures, or any mixture in between.

The structure of aluminum-titanium grain refiners containing boron have historically been an extension of what has been said above for boron-free (Al—Ti) grain refiners. For any given composition, the resulting structure has been a mixture of $TiAl_3$ and $TiB_2$ crystals in a matrix of aluminum saturated with titanium and boron. The prior art has considered the borides to exist only as discreet particles (usually having a hexagonal plate morphology), and the morphology of the $TiAl_3$ crystals has been either blocky or needle-like. In other words, the $TiAl_3$ morphology in the ternary (Al+Ti+B) follows the same rules as in the binary (Al—Ti) grain refiners. The only apparent difference is the presence of "free" $(Al.Ti)B_2$ or $TiB_2$ crystals.

Examples of attempts to control the blocky and needle structures may be found typically in U.S. Pat. Nos. 3,785,807; 3,857,705; and 3,961,995. These patents disclose several concepts to obtain improved grain refining alloys. These disclosures are often contradictory and do not clearly solve the problems.

OBJECTS OF THE INVENTION

One of the most important objects of this invention is to provide an improved, more efficient grain refiner. Another important object of this invention is to provide a novel means to control the effectiveness of the grain refiner. A further object of this invention is to provide controlled processing steps that will produce improved grain refiners.

SUMMARY OF THE TNVENTION

Said objects are realized by the provision of novel grain refiners that contain an effective amount of a complex boron-containing aluminide crystal labeled herein as a "duplex" crystal. This so-called "duplex" crystal is obtained by (1) producing aluminide crystals which contain boron in solution (these crystals are labeled $(Ti.B)Al_3$ and (2) aging said crystals for a sufficient time to precipitate all, or at least some, of the boron in solution. This results in the desired "duplex" structure of $(Ti.B)Al_3$ and $(Al.Ti)B_2$. Other structures may also be formed, such as $TiAl_3$ and $TiB_2$, as are well known in the art.

This "duplex" crystal is an extremely potent grain refining agent.

This duplex structure is a third aluminide structure as depicted below:

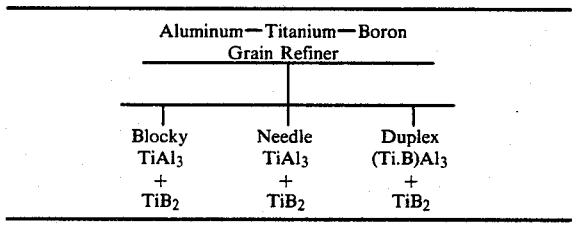

It should be noted that this structure can be present in grain refiners of varying bulk composition.

The "duplex" structure has been observed to occur by chanc in minute quantities (less than about 2 to 5%) in grain refiners produced by methods available in the prior art. But, there was no discovery that it is effective in promoting the highest degree of grain refinement. Thus, this discovery, in combination with the discovery of methods to promote the formation of larger amounts of duplex crystals, is the gist of this invention.

BRIEF DESCRIPTION OF THE DRAWINGS

FIG. 1 presents SEM photographs of the blocky type of $TiAl_3$.

FIG. 2 presents certain irregular "duplex" structures at various magnifications for clarity.

FIG. 6 shows the effect of holding times.

FIG. 7 is the preferred flow chart of the processing steps.

DESCRIPTION OF THE INVENTION

Experimentation has been directed towards a thorough understanding of present processes and products. During the investigation of existing grain refiners, it became apparent that two batches of the same product, apparently produced in nearly the same manner, behave differently when used as a grain refiner. When the bulk chemistry was checked, no significant difference could be found, so the reason for the difference between the two products was obscure.

As a result, a procedure was devised to reveal the three dimensional morphology of the aluminides in situ. By using an iodine-methanol solution, the aluminum matrix was etched away, leaving the aluminides in relief. The deep etched samples were examined with a Scanning Electron microscope (SEM). It was through this method that an understanding of the structure of the aluminides was obtained.

Figure 1A:
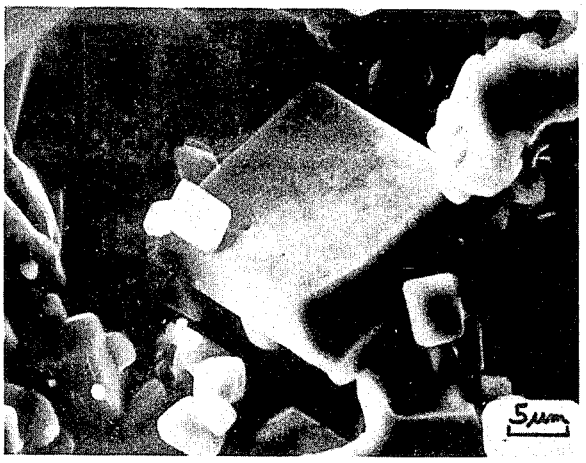
FIG. 1*a* shows the blocky crystal at 2000× magnification.
Figure 1B:
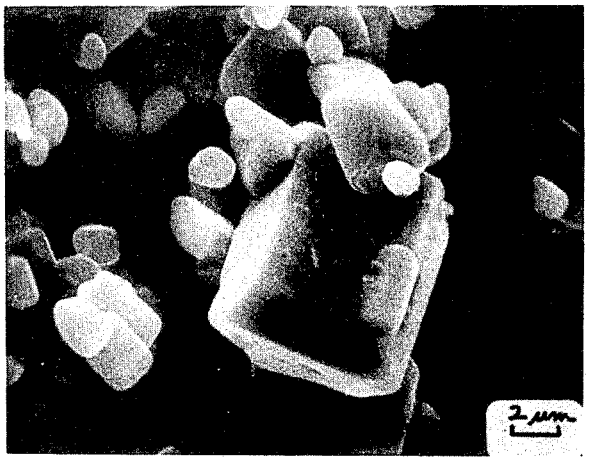
Fig. 1b PRIOR ART
FIG. 1*b* shows the crystal at 4000× magnification.

Using the dissolution procedure, it was noticed that better grain refiners exhibited some aluminides whose morphology deviated from the typical blocky type of $TiAl_3$, which is illustrated in FIG. 1. All the photographs of aluminides are secondary electron images obtained on SEM. FIG. 1*a* shows the blocky crystal at 2000× magnification. FIG. 1*b* shows the crystal at 4000× magnification. The blocky crystal had 10 sides, and one major dimension was larger than the other two dimensions. The surfaces were very smooth and the overall appearance was almost like a cut gemstone. Also visible in the SEM photos was some occasional marbling or streaking of a silicon-containing phase, which did not change the shape of the crystal.

Figure 2A:
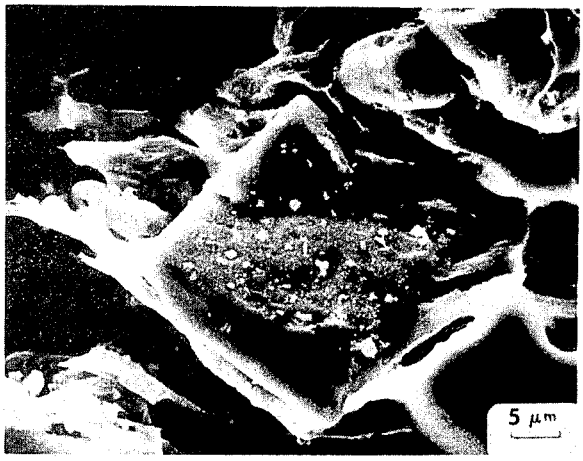
FIG. 2*a* shows the duplex crystals at 1500× magnification.
Figure 2B:
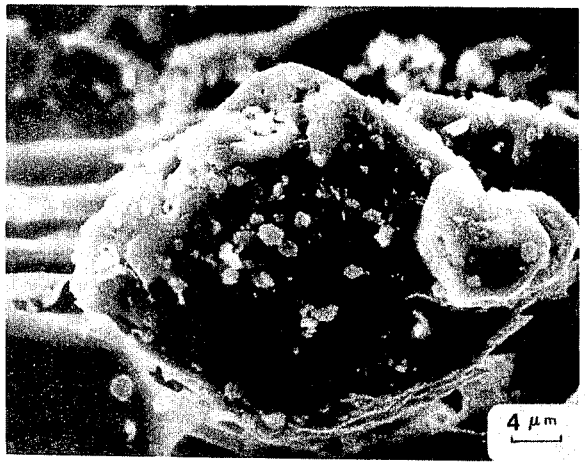
FIG. 2*b* shows the duplex crystals at 2000× magnification.
Figure 2C:
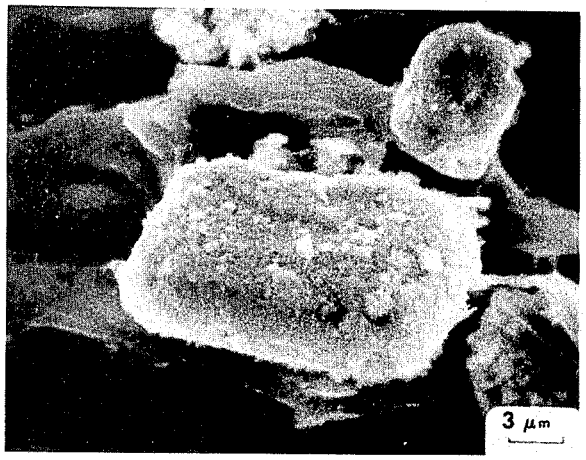
FIG. 2*c* shows the duplex crystals at 3000× magnification.

The second type of aluminide, present in the better products, displayed a wide range of morphologies. Some aluminides showed only some surface roughness; others bear little resemblance to $TiAl_3$. The surfaces of the latter are very rough, and have pock marks and bumps. The number of sides has dropped from 10 to 6, and edges sometimes have an appearance of being layered. In addition, the surface of the "duplex" aluminides are covered with small boride particles. FIG. 2 shows various types of the irregular "duplex" structure. FIG. 2*a* shows the duplex crystals at 1500× magnification. FIG. 2*b* shows the duplex crystals at 2000× magnification. FIG. 2*c* shows the duplex crystals at 3000× magnification. As used herein, the term "duplex" aluminide structure defines this type of aluminide. The "duplex" aluminide structure is the most critical aspect of this invention.

From this structural characterization, it was discovered that grain refining performance could be predicted from the structure of the aluminides, but the process to produce the desired structure remained unknown. In other words, normal process variations in prior art would sometimes accidentally produce a small amount of this superior structure. It was then decided to examine the processing variables more carefully to see what the "accident" was. Then it would be possible to produce the desired structure more efficiently. In fact, by careful control of the structure in a scientific way, it should be possible to produce a grain refiner superior to anything which the prior art has made, once the important factors were established. A series of scoping experiments were then instituted; and it was found that the important process parameters were reaction temperature, flux ratio, stirring speed, order of addition of the reactants, and the amount of holding time. A more detailed explanation of each of these items and a brief description of the process follow.

The process consists of placing aluminum metal into a furnace and bringing it to the reaction temperature. At this time a mechanical stirrer is placed in the molten metal and brought to the correct stirring speed. (Electromagnetic stirring may also be employed.) Titanium bearing salts, and/or possibly titanium sponge (or titanium alloy chips), are added. Then a titanium- and boron-bearing flux is fed to the surface of the melt. When the chemical reaction is complete, the spent (reacted) salt is decanted and the Al-Ti-B grain refiner is placed in a holding furnace, where it is stirred for a predetermined period of time. The more important process parameters are defined below.

1. Reaction Temperature

This is the average temperature of the molten aluminum during the reaction as measured by a thermocouple immersed in the aluminum bath. Since the reaction between the salts and the molten metal can be rapid and violent, it is not feasible to measure the actual reaction temperature at the salt/melt interface. However, the average metal temperature defined here has been found to correlate well with the structure produced.

2. Flux Ratio

A flux is defined as a mechanical mixture of two or more salts. For this investigation, the two salts used were $K_2TiF_6$ and $KBF_4$. The flux ratio is the weight ratio of contained titanium divided by the contained boron in the salt mixture.

3. Stirring Speed

All experiments were conducted with a mechanical stirrer having a flat two-bladed propeller. For convenience the energy input is expressed in RPM since the size of the propeller and crucible was a constant.

4. Order of Addition

For a given grain refiner composition, a number of combinations of salt and/or flux additions can be used. For example, the flux can be a blend of all necessary components. For this case, the procedure would only be to include the flux addition. second example would be this: If the flux contains half of the required titanium, the other half could be added as a salt ($K_2TiF_6$) or as titanium sponge. This remaining, or "excess" titanium, over what is contained in the flux, can be added either before or after the flux addition.

5. Holding Time

Figure 3:
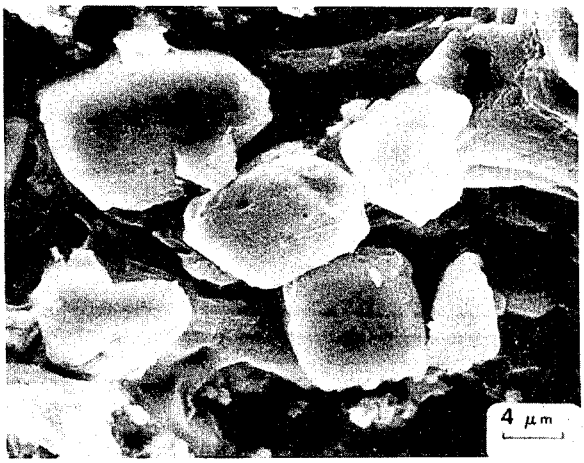
FIG. 3 shows aluminides before the holding step.
Figure 4:
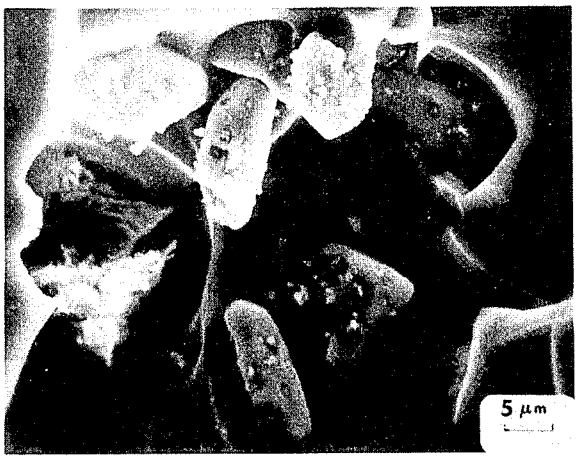
FIG. 4 shows aluminides after the holding step.

This is the amount of time that the melt is held after the chemical reaction between salts and metal has gone to completion. The holding temperature may or may not be the same as the reaction temperature. Also, mechanical or electromagnetic stirring is maintained during the holding time where the alloy is liquid. The stirring speed during the holding period may or may not be the same as in the reaction period. FIGS. 3 and 4 show the effects of holding time. FIG. 3 shows the boron-containing aluminides—$(Ti.B)Al_3$—at 2500× magnification in an alloy prior to the holding step. FIG. 4 shows the aluminides at 1500× magnification in the same alloy after a holding time of 60 minutes. The aluminides after holding are no longer a single phase; borides have precipitated on the surface, forming the desired "duplex" structure. It is clear from this result that the holding time is critical for the formation of the "duplex" structure.

Practical Limits of the Process Variables

There are a large number of combinations of the above conditions that will result in the production of a good grain refiner. At the present time the ranges that can be suggested are:

1. Reaction Temperature—700°-900° C. (1300°-1660° F.)

The lower limit of 700° C. is a practical lower limit to maintain the metal as a liquid. The upper limit of 900° C. will produce a structure that is 90% or more "blocky" with some needles.

2. Flux Ratio—2.2 to 22.5

Depending on the target composition, (for example, 5% Ti-1% B or 5% Ti-0.2% B), the flux ratio to be used should allow for some titanium to be added separately. Thus, if a 5% Ti-1% B grain refiner is to be made, and all Ti and B are added as a flux, then the flux ratio would be 5.0. But the 5.0 flux would not yield the best grain refiner because it does not have a separate titanium addition. (Our experiments show that best results are obtained when 10% or more of the Ti addition is made separately.) Thus, the maximum flux ratio for some commercial alloys would be:

| Composition | Flux Ratio (Ti:B) |
|---|---|
| 5% Ti—1% B | 4.5 |
| 5% Ti—0.6% B | 7.5 |
| 5% Ti—0.2% B | 22.5 |

The maximum limit (22.5) is for certain existing commercial alloys only. If the composition is allowed to change to lower boron levels, as noted in the discussion below, this flux ratio may also increase.

The lower limit (2.2) is imposed because below this ratio there is an excess of boron so that separate crystals of $TiB_2$ are formed, which is not desirable.

3. Stirring Speed—Gentle to Vigorous

The amount of stirring is dependent on the product being produced, the temperature and the flux ratio. Stirring speed during reaction is not of first order of importance, but can help to improve the compromises made in the other variables.

4. Holding Time

Figure 5:
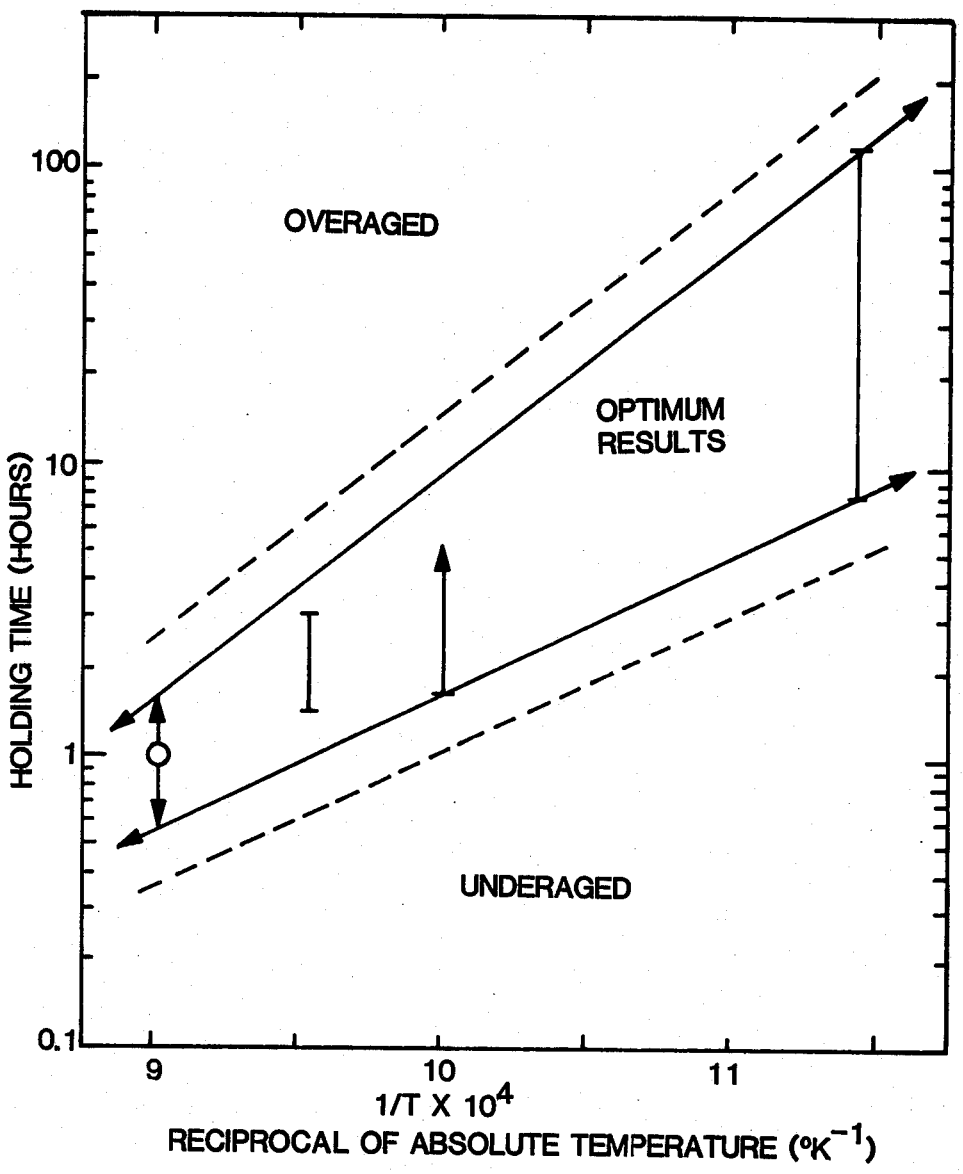
FIG. 5 is a semi-logarithmic plot of the relationship between the holding time and the holding temperature.

The holding time required depends on the holding temperature, as shown in FIG. 5. It seems probable that the precipitation of borides occurs during holding. From theoretical considerations, the time required for a precipitation process to occur is logarithmic with the reciprocal of absolute temperature. Hence, a semi-logarithmic plot has been employed in FIG. 5. The solid bands indicate the optimum holding times found experimentally for a series of high purity laboratory grain refiners having the composition of 5% Ti and 0.2% B. Shorter times (i.e., in the lower portion of the figure) are underaged, so aluminides are similar to those shown in FIGS. 1 and 4. The "duplex" aluminide (examples are shown in FIGS. 2 and 4) occurs at times within the band given by the two solid lines. As shown below, there can be a very substantial improvement in the grain refining performance of materials held for the proper time. The lower and upper solid lines in FIG. 5 represent respectively the beginning and the end of this improvement. The optimum performance is found roughly in the center of the two lines.

Figure 6A:
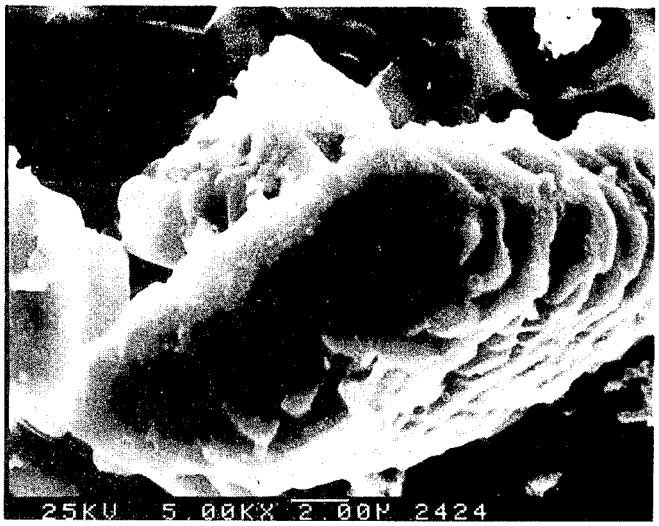
FIG. 6*a* structure after 144 hours at 600° C.
Figure 6B:
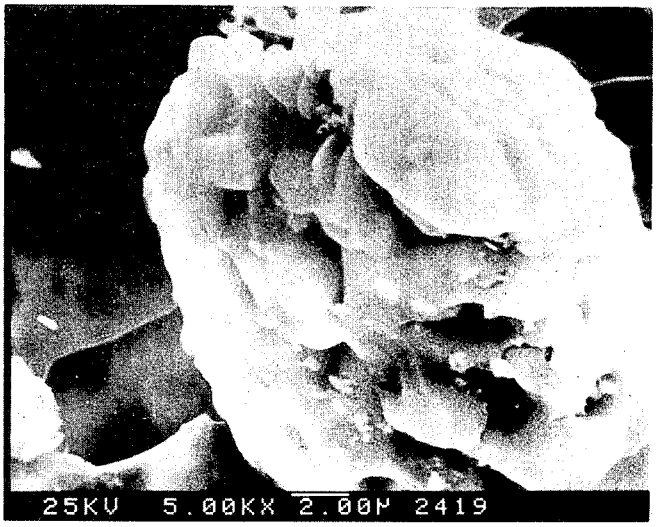
FIG. 6*b* structure after 504 hours at 600° C.

At excessively long holding times the "duplex" structure disappears and an "overaged" condition is found. Examples are given at 5000× magnification in FIG. 6. FIG. 6*a* shows an aluminide produced by holding 144 hours at 600° C. FIG. 6*b* shows an aluminide formed by holding 504 hours at the same temperature. There are very few borides on the surface of these particles; and they are larger in size. Also, the aluminides now have an irregular scalloped or cellular shape on the surface.

It should be noted that the desired "duplex" structure has been produced by aging both in solid and liquid states. (The melting point of aluminum is 660° C.) The lowest practical holding temperature has not been established experimentally, but may be estimated from the lines in FIG. 5. For example, if one is not prepared to hold for more than 1000 hours, the minimum temperature will be about 420° C.

Since the data on holding time in FIG. 5 are for laboratory alloys, and since commercial alloys will have varying amounts of impurities—Fe, Si, V and Cu are most common—it is possible that the correct holding time for commercial alloys may shift somewhat from the results indicated by the two solid lines. The extent of the shift is not possible to predict a priori, but it most probably would change by no more than a factor of 1.5, as indicated by the dashed lines in FIG. 5.

5. Order of Addition

The excess Ti should be added first. If it is added last, it has a harmful effect on the metallurgical quality and also on the recovery.

6. Effective Contents of Duplex Crystals

As stated earlier, duplex crystals have been observed to occur adventitiously in the prior art. It has been observed that such crystals may occur up to about 5% of the aluminides present in the grain refiner. Furthermore, it appears that some beneficial effects of the duplex crystals are noted in contents as low as 2% of the grain refiner. The benefits of this invention are provided when the grain refiner contains more than the range of 2 to 5% duplex crystals as a result of deliberate processing.

The percent of duplex crystals can be determined by measuring the number of duplex and conventional aluminides. One merely needs to divide the total number of duplex aluminides by the total number of all the aluminides and then to multiply by 100 to convert to percent. The number of duplex and conventional aluminides is obtained by examining the deep-etched grain refiner and by using a scanning electron microscope (SEM) as a point-counting machine. In this method, a network of scan areas in the SEM is disposed uniformly over a typical random sample area. The number of duplex and conventional aluminides are tabulated in each scan area, repeating the process until a sufficient number of measurements have been obtained.

FIG. 7 is the preferred flow chart of processing steps to obtain the optimum benefits of this invention. Critical operating parameters are also indicated in FIG. 7 (FIG.

7 is drawn for the case of holding in the liquid state. For the case of holding in the solid, step No. 5 is omitted, and holding at elevated temperature occurs after casting.)

Following are the preferred (optimum) parameters for each of the operation steps, as shown in FIG. 7.

Operation (1)—The stirring speed may be gentle to vigorous with the temperature above the melting point.

Operation (2)—The reaction temperature may be 725°-825° C. with vigorous stirring speed and 10 to 80% excess titanium.

Operation (3)—The reaction temperature may be about 760° C. (±50° C.) at vigorous stirring speed and a flux ratio about 2.2 to 2.8.

Operation (4)—The time to decant salt may be as small as reasonably possible, so that sedimentation of solid particles does not occur.

Operation (5)—The holding time and temperature may be in the range of values indicated by the dashed lines in FIG. 5.

When making alloys of high Ti:B ratios (15 to 50 or more), the following parameters are suggested:

(1) when excess titanium is about 10%, the flux ratio may be 13.5 to 45;

(2) when excess titanium is over 80%, the flux ratio may be 2.5 to 3.0.

DISCUSSION AND SUMMARY

The duplex crystal structure has been seen to be produced by a well defined sequence of processing steps. Firstly, there is the simultaneous reduction of boron- and titanium-containing salts by stirred liquid aluminum. This produces an aluminide crystal which appears to contain boron in solution: the (Ti,B) $Al_3$ phase shown in FIG. 3. Then after a specified holding period at elevated temperature; as shown in FIG. 5; boride particles precipitate and the duplex structure forms.

Figure 8:
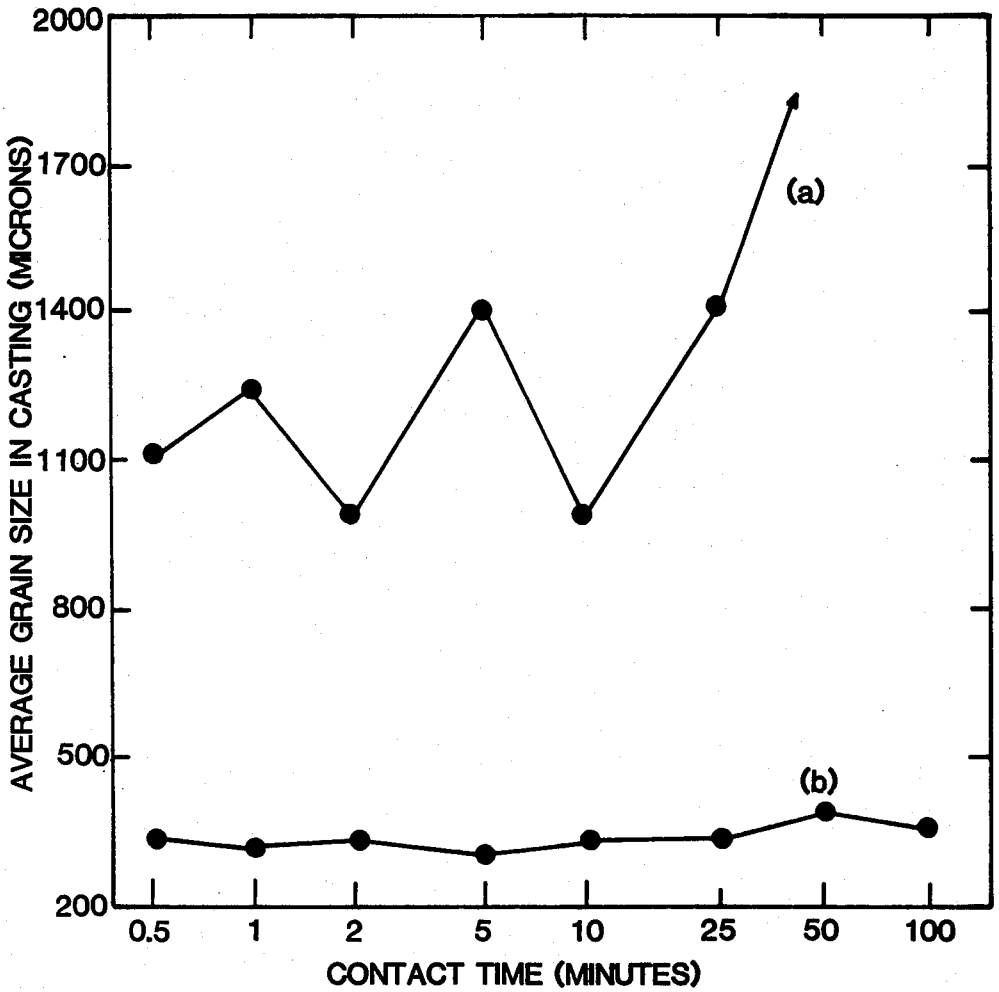
FIG. 8 shows the effects of "contact time" for a heat with or without a 5-hour holding time at 700° C.

That this well-defined processing sequence produces the duplex structure has been shown earlier by the SEM photographs in FIGS. 2 and 4. The effect on grain refining response is shown in FIG. 8 for a commercial heat of grain refiner having 5% Ti and 0.2% B. Very small quantities of this grain refiner (0.001% Ti addition level) were added to a melt of 99.7% Al held at 800° C., and small castings were made at times of ½, 1, 2, 5, 10, 25, 50, and 100 minutes after the addition. The castings were then etched with acid to reveal the grain structure, and the average grain size was measured under a stereo microscope by using the line intercept method. The time after the grain refiner addition is called the "contact time",—that is, the time the grain refiner has been in contact with the 99.7% Al melt.

These tests represent an additional level of one part of grain refiner for each 5000 parts of liquid metal. This is a very severe test, and clearly establishes the difference in performance between the prior art and the novel duplex structure. Curve (a) in FIG. 8 (the upper curve) represents a sample of an alloy cast at the end of processing step number 4 in FIG. 7. (That is, the holding period was ommitted.) Curve (b) in FIG. 8 is for the same alloy as in curve (a), only it has been held for 5 hours at about 700° C. In other words, two portions of the same heat are shown here. Curve (a) is for a structure not held for times sufficient to produce the duplex structure. Less than about 2% of the aluminides were duplex. The grain size found in the castings containing this refiner is fairly large, and the grain refining effect fades after 25 minutes. Curve (a) is typical of product produced according to the prior art. The product in curve (b), however, is much better, since about one-fifth of the aluminides in this grain refiner were duplex. Not only were finer grains obtained, but no fading was observed at contact times of 100 minutes.

A single, well-defined, sequence of processing steps has been found to produce a superior grain refiner. However, now that the discovery of the duplex structure has been made, it is easy to envision other processes that would produce a similar product.

One simple example of a different process would be the use of a different flux. $K_2TiF_6$ and $KBF_4$ were used here, but other titanium- and boron containing halogens are available (e.g., $NaBF_4$ and $Na_2TiF_6$). One could also envision the simulaneous reduction of $TiO_2$ and $B_2O_3$, which have a small, but finite, solubility in potassium- and sodium cryolyte melts. For this reason, the partial or complete substitution of $KBF_4$ or $K_2TiF_6$ with other compounds—as long as the same structure is produced— must be considered as part of this discovery.

It is also possible to imagine another possibility. The active role of boron in the duplex structure is apparently to act as a catalyst to change the structure of the aluminide—$TiAl_3$. It is well known that neighboring elements of the periodic table have similar chemical properties, so the partial substitution of boron with these elements (such as C, Si, N, P, Be, and Mg) must also be considered to be part of this discovery.

In a similar fashion, one could partially replace Titanium with its neighbors (V, Zr, Cb, Hf, and Ta come to mind.)

What is claimed is:

1. A grain refiner that contains more than 5% duplex crystals obtained by producing aluminide crystals containing boron in solution, and aging said aluminide crystals for a sufficient time and temperature to precipitate at least part of the boron to form said duplex crystals having a structure of $(Ti+B)Al_3$ said grain refiner consisting essentially of, in weight percent, 0.5 to 5 boron, 2 to 12 percent titanium and the balance aluminum plus normal impurities.

2. The grain refiner of claim 1 wherein the combination of aging time and temperatures employed fall between the dashed lines of FIG. 5.

* * * * *